United States Patent [19]

McCallister

[11] Patent Number: 5,014,992

[45] Date of Patent: May 14, 1991

[54] GOLF PUTTER WITH SWING DIRECTING CUES

[76] Inventor: John McCallister, 4141 Whitsett Ave., Studio City, Calif. 91604

[21] Appl. No.: 448,061

[22] Filed: Dec. 8, 1989

[51] Int. Cl.[5] ..... A63B 53/04

[52] U.S. Cl. ..... 273/164; 273/167 R; 273/167 G

[58] Field of Search ..... 273/163 R, 164, 167 D, 273/167 J, 183 D, 80.5, 80 C, 167 B, 167 F, 167 H, 169, 168, 80 R, 80.1, 80.2, 80.3, 80.4, 80.6, 80.7, 80.8, 80.9; D21/217, 218, 219

[56] References Cited

U.S. PATENT DOCUMENTS

| | | | |
|---|---|---|---|
| D. 231,375 | 4/1974 | Solheim | 273/80 C |
| D. 239,637 | 4/1976 | Loggins | D21/217 |
| D. 298,767 | 11/1988 | Szczepanski | D21/219 |
| 2,361,415 | 10/1944 | Reach | 273/80.5 |
| 2,463,798 | 3/1949 | Paisley | 273/163 R |
| 3,077,350 | 2/1963 | Koorland | 273/164 |
| 3,360,268 | 12/1967 | Molinari | 273/186 |
| 3,448,981 | 6/1969 | Anweiler | 273/167 G |
| 4,000,902 | 1/1977 | Perkins | 273/164 |
| 4,265,451 | 5/1981 | Bernhardt | 273/167 G |
| 4,289,311 | 9/1981 | Smith | 273/167 F |
| 4,367,877 | 1/1983 | Gibson et al. | 273/164 |
| 4,411,429 | 10/1983 | Drew et al. | 273/164 |
| 4,508,342 | 4/1985 | Drake | 273/80 C |
| 4,527,799 | 7/1985 | Solheim | 273/164 |
| 4,693,478 | 9/1987 | Long | 273/164 |
| 4,747,599 | 5/1988 | Antonious | 273/167 |
| 4,787,636 | 11/1988 | Honma | 273/167 R |

*Primary Examiner*—Edward M. Coven
*Assistant Examiner*—William M. Pierce
*Attorney, Agent, or Firm*—Poms, Smith, Lande & Rose

[57] ABSTRACT

A putter which provides visual cues to the golfer that promote a putting stroke having a vertical arc component. The club head includes a top surface which is slanted downward toward the ball and an elbow-shaped hosel which extends forwardly from the top face. The configuration and relationship between the hosel and top face creates a visual image which, when viewed from the golfer's perspective, promotes a pendulum-type putting stroke which includes a vertical arc component.

11 Claims, 2 Drawing Sheets

Fig. 8.
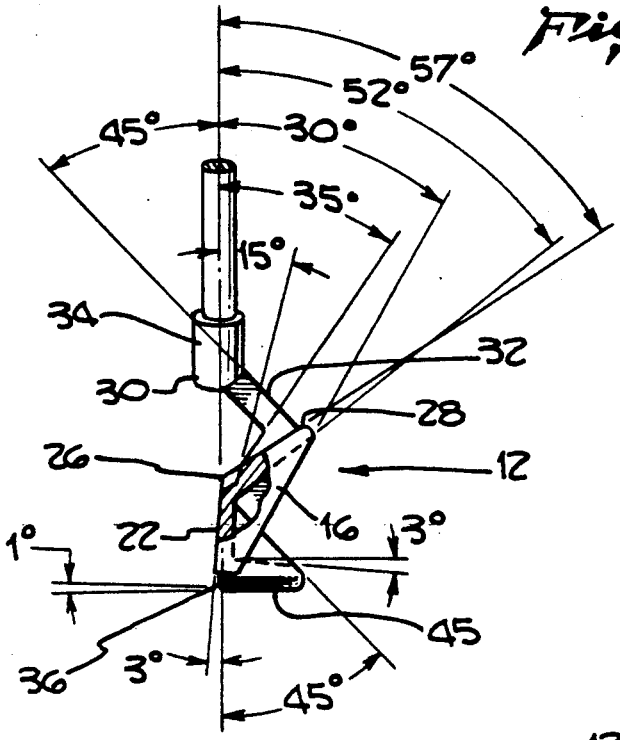
Fig. 7.
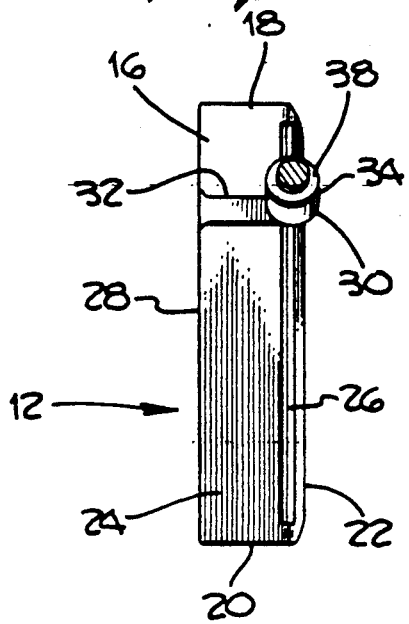
Fig. 10.
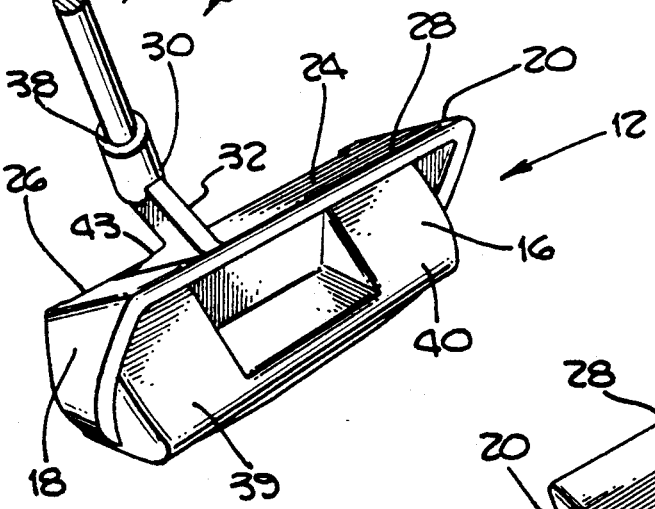
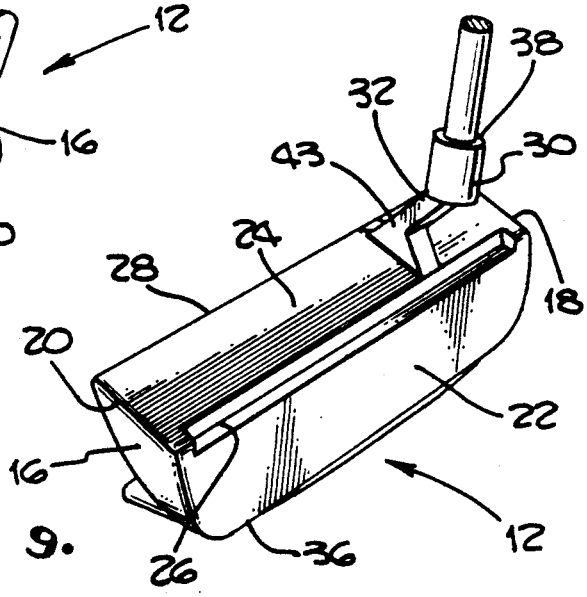
Fig. 9.

GOLF PUTTER WITH SWING DIRECTING CUES

BACKGROUND OF THE INVENTION

1. Field of the Invention

The present invention relates generally to golf club heads which are designed to provide visual cues which promote certain desirable golf swing characteristics. More particularly, the present invention relates to a putter which is designed to promote the proper vertical arc for the putting swing.

2. Description of Related Art

Golf clubs come in a wide variety of designs and configurations. The three basic types of golf clubs are the woods or distance clubs, the irons and the putters. All three club types include a club head body having a front face for striking the ball and a hosel for connecting the club head body to the golf club shaft. Although the different types of clubs include the same basic elements, they vary drastically in structure and shape. The woods and irons are used to propel the ball in the air at distances ranging from a few yards up to 300 yards and more. The swing for these clubs is usually a full swing where the club head is moving at a rapid speed. Even when partial swings are made for short shots, the club head is moving very rapidly. In contrast to the irons and woods, the putter is used almost exclusively on the green to tap the ball into the cup from short distances. Putting is an exact art requiring a relatively slow swing. Putting can be one of the most difficult parts of the game because of the preciseness required for the stroke. It is extremely important that the stroke technique used in putting be capable of providing reproducible accuracy and control.

The pendulum putting stroke is recognized by the majority of golfers as being a desirable stroking method. Pendulum stroking is where the putter, hands, arms and shoulders move together in unison having a stationary point of rotation at the top of the spine. The stroke is called pendulum because it is similar to the motion of the pendulum of a clock. Like the movement of the pendulum of a clock, the pendulum stroke creates a vertical arc.

The vertical arc of the pendulum stroke includes the backstroke, the downstroke and the throughstroke. An important feature of the pendulum stroke is that the putter naturally elevates off the ground on the backstroke, descends and accelerates back to the ball on the downstroke and ascends and decelerates on the throughstroke. Pendulum stroking differs from striking the ball in that the forward movement of the putter is continuous from its starts to its completion at the follow-through. Inherent in the pendulum stroke is the smooth, continuous and accelerating movement of the putter which results in reproducible accuracy and control. The golfer's concentration during the pendulum stroke is on moving the putter with the result being that the ball becomes an indirect receptor of the stroking motion.

Many golfers tend to pull the putter back horizontally during the backstroke. This horizontal movement prevents the golfer from performing a pendulum-type stroke where the putter naturally elevates vertically during the backstroke. Horizontal movement of the club head causes horizontal hitting of the ball instead of the desired pendulum stroking. Such horizontal hitting is difficult to control and, as a result, putting accuracy and control suffer.

Existing putter designs have done nothing to correct the above-mentioned putting swing defect. Instead, present putter designs tend to promote a horizontal back swing. For example, present putters position the hosel parallel to the striking face of the putter. This arrangement emphasizes the substantially vertical putting face and promotes horizontal movement of the putter during both the back swing and front swing. Instead of correcting horizontal hitting of the ball, the visual cue provided by the vertical putting face and interconnected parallel hosel further promotes this undesirable horizontal hitting.

The top surfaces on existing putters are designed exclusively to provide ball alignment and horizontal positioning. The top surfaces typically include any number of arrows or cue lines which are designed to help the golfer line up the putt. In order to provide such visual alignment information, the putter's top face usually includes a substantial flat area. This flat area may be helpful in providing alignment indicia; however, the flat surface also provides a visual image which promotes an undesirable horizontal back swing. As a result, the benefits of proper alignment provided by such flat top putter is lessened because the golfer tends to pull the putter straight back, thereby destroying the desired pendulum swing.

It would be desirable to provide a putter having a configuration which visually promotes the desired pendulum putting stroke. The putter should not only promote the pendulum putting stroke, but should also promote continuous and smooth acceleration of the putter during the forward stroke prior to ball contact. Further, the putter should provide these benefits without lessening the golfer's ability to align and position the putter prior to initiating the stroke.

SUMMARY OF THE INVENTION

In accordance with the present invention, a putter head is provided which is designed to provide visual cues to the golfer to promote a pendulum putting stroke having a vertical arc component. The invention is based on the discovery that a putter head with a downwardly-sloping top face that is connected to a forwardly extending hosel provides a visual cue to the golfer which promotes a desirable vertical arc to both the back swing and forward swing which is an essential part of the pendulum putting stroke. Such a configuration also promotes acceleration of the club head on the forward swing just prior to ball contact.

The putter head in accordance with the present invention includes a putter head body having a heel portion, toe portion, a front face for contacting the golf ball, and a top face having a front edge at the putter body front face and a rear edge. As a feature of the present invention, the top face slopes downward from its rear edge to its front edge and is connected to the putter shaft by a forwardly extending elbow-shaped hosel. This elbow connection between the downwardly sloping top face and shaft provides a visual cue or visual lever when viewed from above by the golfer that promotes an upward arc during the back swing and a downward arc during the forward swing. This coincides with an reinforces the desired pendulum putting stroke. Further, the elbow shaped connection promotes a downward arc during the forward swing which results in an inherent and desirable acceleration of the putter head just prior to ball contact.

As a feature of the present invention, the slope of the top face of the putter head is increased or decreased depending on the golfer and the desired arc for the swing. This feature allows fine tuning of the golf swing to promote a shallow or steep arc, depending upon golfer preference and putter face slope.

As a further feature of the present invention, the upper surface of the hosel where it is connected to the shaft is slanted to match the slope of the putter head body top surface in order to provide further reinforcement of the visual cue or lever which is inherent in the elbow connection between the hosel and putter head body top surface.

The above discussed and many other features and attendant advantages of the present invention will become better understood by reference to the following detailed description when taken in conjunction with the accompanying drawings.

BRIEF DESCRIPTION OF THE DRAWINGS

FIG. 7 is a top view of FIG. 3 taken in the 7—7 plane.

FIG. 8 is a detailed partial sectional view of the preferred exemplary putter showing preferred orientation angles.

FIG. 9 is a front perspective view of the preferred exemplary putter in accordance with the present invention.

FIG. 10 is a rear perspective view of the preferred exemplary embodiment of the putter in accordance with present invention.

DETAILED DESCRIPTION OF THE INVENTION

Figure 1:
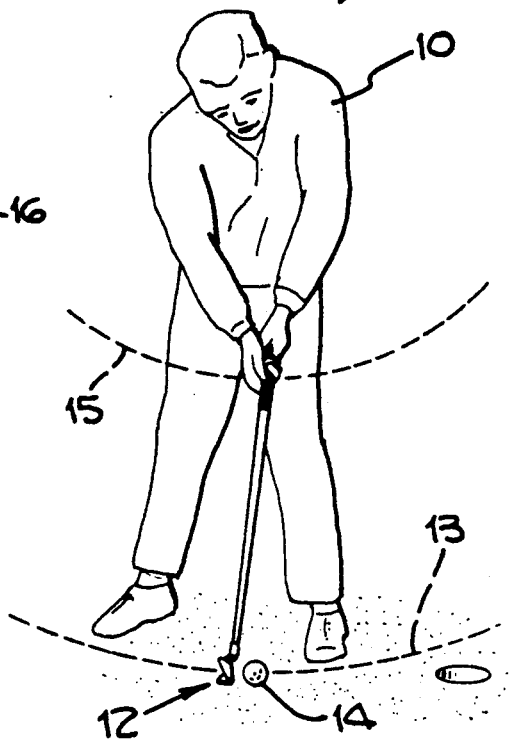
FIG. 1 is a general view of a golfer using a preferred exemplary putter in accordance with the present invention.

A first preferred exemplary putter in accordance with the present invention is shown in FIGS. 1–10. In FIG. 1, a golfer 10 is shown aligning the putter head 12 with respect to golf ball 14. Phantom lines 13 and 15 are shown in FIG. 1 to depict the arc followed by the putter head 12 and golfer's hands, respectively, during a pendulum-type putting stroke. The pendulum swing includes a vertical arc component, as represented by phantom lines 13 and 15, where the putter head arcs upward during the back swing and then arcs back downward along the same path during the front swing. The pendulum-type swing is desirable because the putter head, golfer's arm and shoulders all rotate about a fixed point. This type of swing is recognized to provide an accurate and reproducible putting smoke that is well suited for putting. The downward slope of the arc followed by the putter head 12 during the front swing also promotes acceleration of the putter head 12 prior to ball contact, which is also a desired feature of a good putting stroke.

An important aspect of the present invention involves the visual shape and configuration of the putter head 12 as viewed by the golfer 10 from above. As will be described in detail below, the downward sloping top face of the putter and the perpendicular connection of the hosel produce an elbow-shaped image which emphasizes the sloping nature of the top face and de-emphasizes the putter front face. When viewed from above by the golfer, the elbow arrangement provides a visual cue or lever which promotes a vertical golf swing arc and tends to make the golfer accelerate the club head during the downward arc of the forward stroke just prior to ball contact.

Referring to FIGS. 2–10, the putter head 12 includes a putter head body 16 which includes a heel portion 18 and a toe portion 20. The putter head 12 further includes a front face 22 for contacting golf ball 14. The front face 22 is substantially vertical or may have a slight angle in accordance with conventional designs for the front face or ball contact face of a putter. A slope angle of about 3°, as shown in FIG. 8, is preferred.

The putter head 12 includes a top face 24 which has a front edge 26 and rear edge 28. The top face 24 slopes downward from the rear edge 28 to the front edge 26. Onto the downwardly sloping top face 24 is connected an elbow-shaped hosel 30. The hosel 30 includes connecting segment 32 and shaft receptacle 34. The connecting segment 32 and shaft receptacle 34 are an integral element which, as best shown in FIGS. 7, 9 and 10, appear to the golfer as an elbow-shaped element perpendicularly connected to the downwardly sloping face 24. The combination of the downward sloping top face 24 and the elbow-shaped hosel 30 provides a visual cue to the golfer which tends to make the golfer swing the putter head 12 in a vertical arc and also visually promotes an acceleration of the putter head by the golfer as the putter head is moved through the downward arc of the forward stroke just prior to ball contact. This arrangement also visually promotes a swing wherein the putter head is forced down and through the ball 14.

Figure 6:
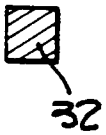
FIG. 6 is a sectional view of FIG. 3 taken in the 6—6 plane.

As best shown in FIG. 6, the connecting segment 32 has a square cross-section. However, connecting segments with other cross-sectional shapes are possible, including circular or oval cross-sections. The important consideration is that the elbow-shaped hosel 30 forwardly extends from the top surface 24 as best shown in FIGS. 3 and 7–10. The connecting segment 32 of hosel 30 is attached to and extends forwardly from the putter body top face 24. As best shown in FIG. 8, the connecting segment 32 extends from top face 24 at an exterior angle of about 120°. This is a preferred arrangement with angles of between about 105° to 75° being possible.

The downward slope of top face 24 is preferably between about 30° to 45° relative to horizontal. These slopes work best for promoting the correct swing for putter-type club heads. The slope of top face 24 may be increased or decreased in certain situations if more or less visual cuing is required. A preferred downward slope of top face 24 for a putter head is about 33° relative to horizontal.

Figure 5:
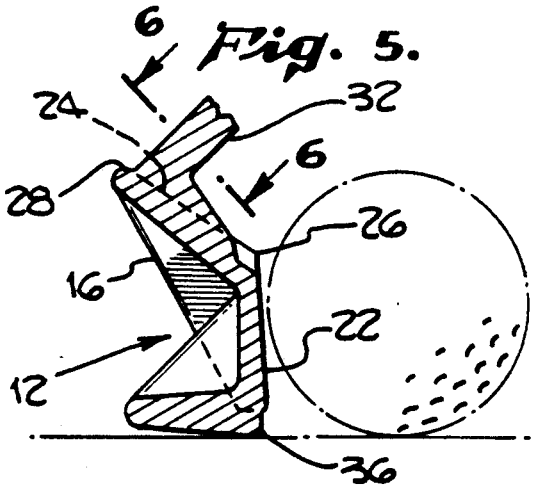
FIG. 5 is a sectional view of FIG. 4 taken in the 5—5 plane.
Figure 3:
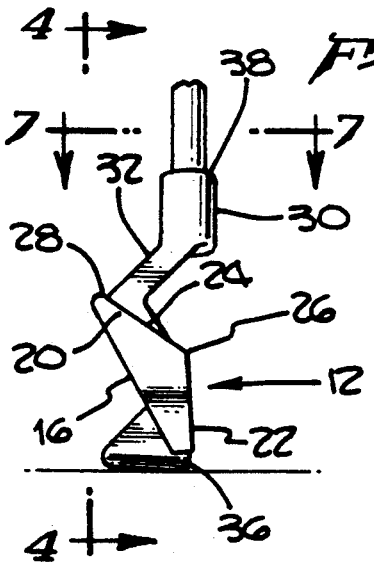
FIG. 3 is a side view of the preferred exemplary putter head shown in FIGS. 1 and 2.
Figure 2:
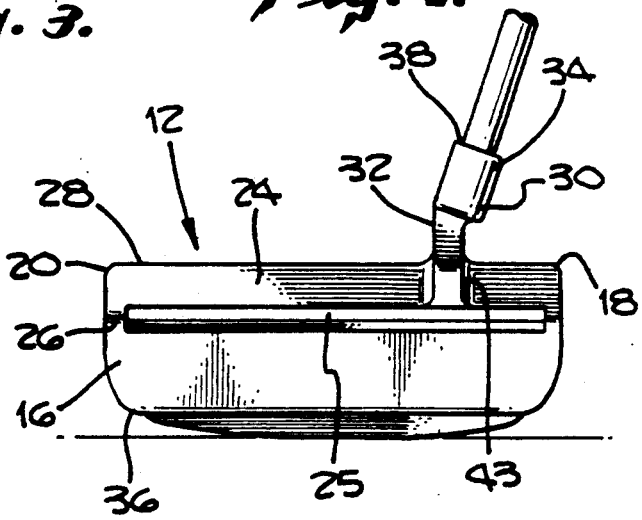
FIG. 2 is a front view of the preferred exemplary putter shown in FIG. 1.

Although it is not necessary, it is preferred that the width of the top face 24 between the front edge 26 and rear edge 28 be greater than the width of the front face 22 between the front edge 26 and bottom edge 36 (see FIGS. 3, 5 and 7). This is desirable because a top face 24 having a greater width than the front face 22 increases and emphasizes the visual cue provided by the top surface an its perpendicular relationship to hosel 34. Also, it is preferred that a longitudinal indentation 25 (see FIG. 2) be provided at the front edge 26 of the top surface. This indentation enhances the downwardly sloping visual image provided by the top surface 24 when viewed from above by the golfer.

The shaft receptacle 34 includes a top annular surface 38 which may be perpendicular to the shaft receptacle 34 axis or it may have a downward slope that matches the downward slope of the top surface 24. Although not absolutely necessary, a matching slope between the neck surface 38 and top surface 24 provide a further reinforcement and enhancement of the visual cues presented to the golfer 10 during alignment of the club head, during the back stroke and during the forward stroke of the putter head 12.

Figure 4:
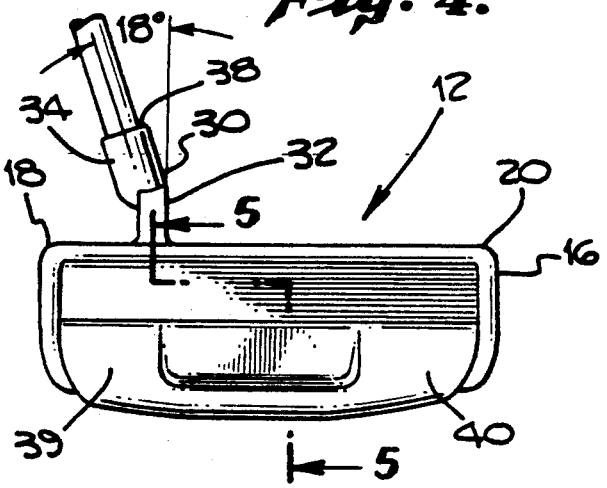
FIG. 4 is a rear view of the preferred exemplary putter shown in FIGS. 1, 2 and 3.

The rear portion of putter head 12 is preferably shaped as shown in FIGS. 4 and 10 wherein a heel weight portion 39 and toe weight portion 40 are utilized. The heel weighting and toe weighting of putters and other clubs is well known and does not form part of the invention other than the fact that such heel and toe weighting is generally considered to be preferred in most club head designs.

The putter hosel 30 may be connected to the top surface of the putter body at different locations. Preferably, the hosel will be attached near the rear of the top surface and near the head portion, as best shown in FIGS. 2, 3 and 7–10. However, the hosel 30 may be connected to the center of the top surface or any other location conventionally used for connecting the hosel to the putter body. The preferred attachment includes a shoulder 43 which is designed to provide a secure connection between the hosel 30 and top surface 24 while additionally providing enhancement of the downward sloping visual cue provided by top surface 24.

The connecting segment 32 which extends from the top surface 24 is preferably of sufficient length so that the shaft receptacle 34 is located either directly over or in front of the front edge 26 of the top face. The preferred orientation is best shown in FIG. 7 where the shaft receptacle 34 is shown directly over front edge 26 when viewed from above by the golfer. As best shown in FIG. 8, the shaft receptacle 34 is substantially perpendicular to the putter head bottom 45 or the surface upon which the putter is placed. The shaft receptacle 34 is parallel to the front face 22 when the front face 22 has a 0° slope. As shown in FIG. 8, the front face 22 has a 3° slope. It is preferred that the shaft receptacle 34 remain perpendicular to the putter head bottom 45, irrespective of the slope of the front face 22. This ensures that the shaft receptacle 34 extends perpendicularly from the surface upon which the putt is to be made.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein.

What is claimed is:

1. A putter head adapted to provide a visual cue to a golfer which promotes a putting stroke having a vertical arc component, said putter comprising:

a putter head body having a heel portion, toe portion, a sole, a front face for contacting a golf ball and top face having a front edge at said front face and a rear edge wherein said top face slopes towards said bottom face from the rear edge of said top face to the front edge of said top face;

a hosel extending from said top face of said putter body, said hosel having a putter head body attachment end and a shaft attachment end, said hosel attachment end being attached directly to and extending forwardly with respect to the front face from said sloped putter head body top face, said hosel and sloped top face thereby providing a visual cue to said golfer which promotes a putting stroke having a vertical arc component.

2. A putter head according to claim 1 wherein the top face of said putter head body is sloped at an angle of between 30° to 45° relative to said sole.

3. A putter head according to claim 2 wherein the top face of said putter head body slopes towards said sole at an angle of 33° relative to said sole.

4. A putter head according to claim 1 wherein the putter head body attachment end of said hosel extends from said top face at an angle of between 105° to 75°.

5. A putter head according to claim 1 wherein said hosel is connected to the top face of said club head body at said heel portion.

6. A putter head according to claim 1 wherein the shaft attachment end of said hosel is located vertically over the front edge of said top face.

7. A putter head according to claim 1 wherein the shaft attachment end of said hosel includes a top annular surface, wherein said top annular surface is sloped to match the slope of the top surface of said putter head body.

8. A putter head according to claim 1 wherein said front face includes a bottom edge and wherein the width of said top face between said front edge and rear edge is greater than the width of said front face between said front edge and bottom edge.

9. A putter head according to claim 1 wherein the shaft attachment end of said hosel is located in front of the front edge of said top face.

10. A putter head according to claim 1 wherein said front edge includes a longitudinal indentation.

11. A putter head according to claim 1 wherein said bottom face includes a front edge and a rear edge and wherein the width of said top face between said front edge and rear edge is greater than the width of said bottom face between said front edge and rear edge.

* * * * *